US006325120B1

(12) United States Patent
Douglas

(10) Patent No.: US 6,325,120 B1
(45) Date of Patent: Dec. 4, 2001

(54) COVER FOR EARTH BORING DRILL

(76) Inventor: Kevin J. Douglas, 515 S. A St., Albia, IA (US) 52531

( * ) Notice: Subject to any disclaimer, the term of this patent is extended or adjusted under 35 U.S.C. 154(b) by 0 days.

(21) Appl. No.: 09/405,579

(22) Filed: Sep. 27, 1999

(51) Int. Cl.[7] ..... B65D 65/02
(52) U.S. Cl. ..... 150/154; 190/26
(58) Field of Search ..... 224/651; 294/150, 294/149, 151; 190/26; 150/154, 156, 157; 175/424

(56) References Cited

U.S. PATENT DOCUMENTS

D. 316,483 * 4/1991 Haack ..... D3/76
D. 344,409 * 2/1994 Meredith ..... D3/76
2,647,595 * 8/1953 Meyers ..... 190/26
4,221,085 * 9/1980 Conaghan ..... 150/154 X
4,478,452 * 10/1984 Clemens ..... 294/141
5,228,408 * 7/1993 Jannausch ..... 114/361
5,829,653 * 11/1998 Kaiser ..... 224/577
6,092,856 * 7/2000 Ladensack ..... 296/100.11

* cited by examiner

*Primary Examiner*—Allan N. Shoap
*Assistant Examiner*—Tri M. Mai
(74) *Attorney, Agent, or Firm*—Zarley, McKee, Thomte, Voorhees & Sease

(57) ABSTRACT

A cover for an earth boring tool having a canopy with opposite sides, opposite ends, a top portion, and a bottom portion. A plurality of straps are secured to one side of canopy, extend across the open bottom portion, and are detachably secured to the opposite side of the canopy. The end straps, when detachably secured, align with the edges of the opposite ends to form a temporary seal.

3 Claims, 3 Drawing Sheets

COVER FOR EARTH BORING DRILL

BACKGROUND OF THE INVENTION

Guided earth boring tools are well known in the art as shown by U.S. Pat. No. 4,858,704 by McDonald, et al. Such devices comprise a plurality of drill rods which when not in operation are stored in an open box above the ground. The ends of the rods have both male and female threads to which plastic caps are presently attached to protect the ends of the drill rods from dirt and moisture when not in use. The process of attaching and removing the caps is a cumbersome time consuming task. As a result, there is a need for an easier, less time consuming way, of protecting the ends of the drill rods from the elements when not operational.

Therefore, the primary object of the present invention is to provide an easy way to cover the ends of drill rods on an earth boring device.

Another object of the present invention is to provide a cost efficient durable cover for the ends of drill rods on an earth boring device.

These and other objects, features, and advantages of the present invention will become apparent with reference to the accompanying specification and claims.

SUMMARY OF THE INVENTION

The invention is a cover assembly for an earth boring device wherein the canopy has opposite sides, opposite ends, a top portion, and an open bottom. The canopy has a plurality of straps secured to one side that extend across the open bottom and are detachably secured to the opposite side of the canopy. The end straps, when extended across the open bottom and detachably secured to the opposite sides align with the opposite ends forming a temporary seal.

DETAILED DESCRIPTION OF INVENTION

Figure 1:
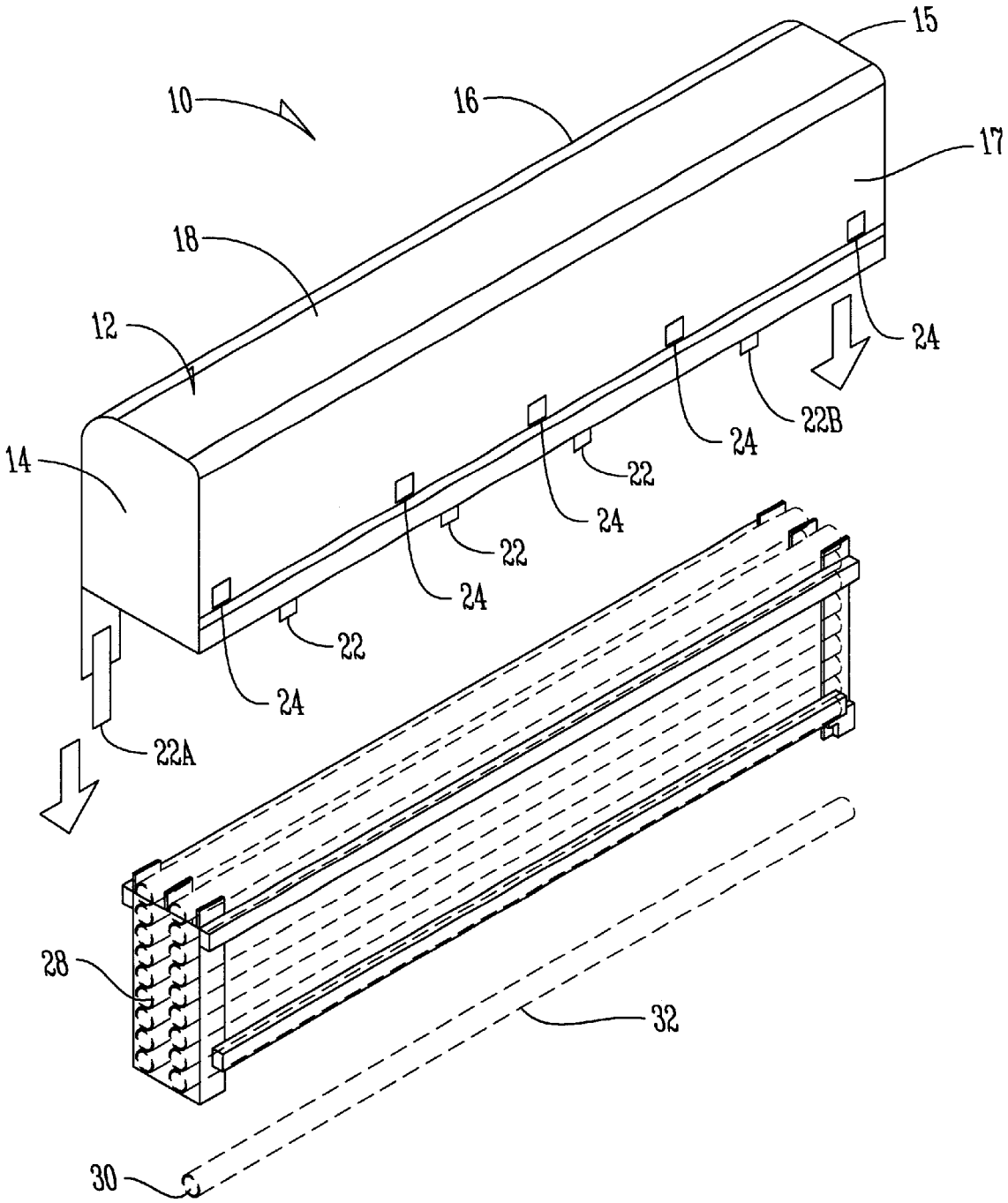
FIG. 1 is an exploded perspective view of the cover positioned over the tool storage box.

With reference to the drawings, a cover 10 for an earth boring tool embodying the principals and concepts of the present invention will be described.

The cover 10 is comprised of a canopy 12 with opposite ends 14, 15, opposite sides 16, 17, a top portion 18, and an open bottom 20. The cover 10 is designed to fit over the storage box 28 of an earth boring tool to cover the ends 30 of a plurality of drill rods 32.

Secured to one side 16 of the cover 10 is a plurality of straps 22 that extend across the open bottom 20 and are detachably secured to the opposite side 17. The straps 22 are secured to the side 16 by any conventional means and are detachably secured to side 17 by any conventional means including without limitation buckles 24, snaps, Velcro® and ties.

Figure 2:
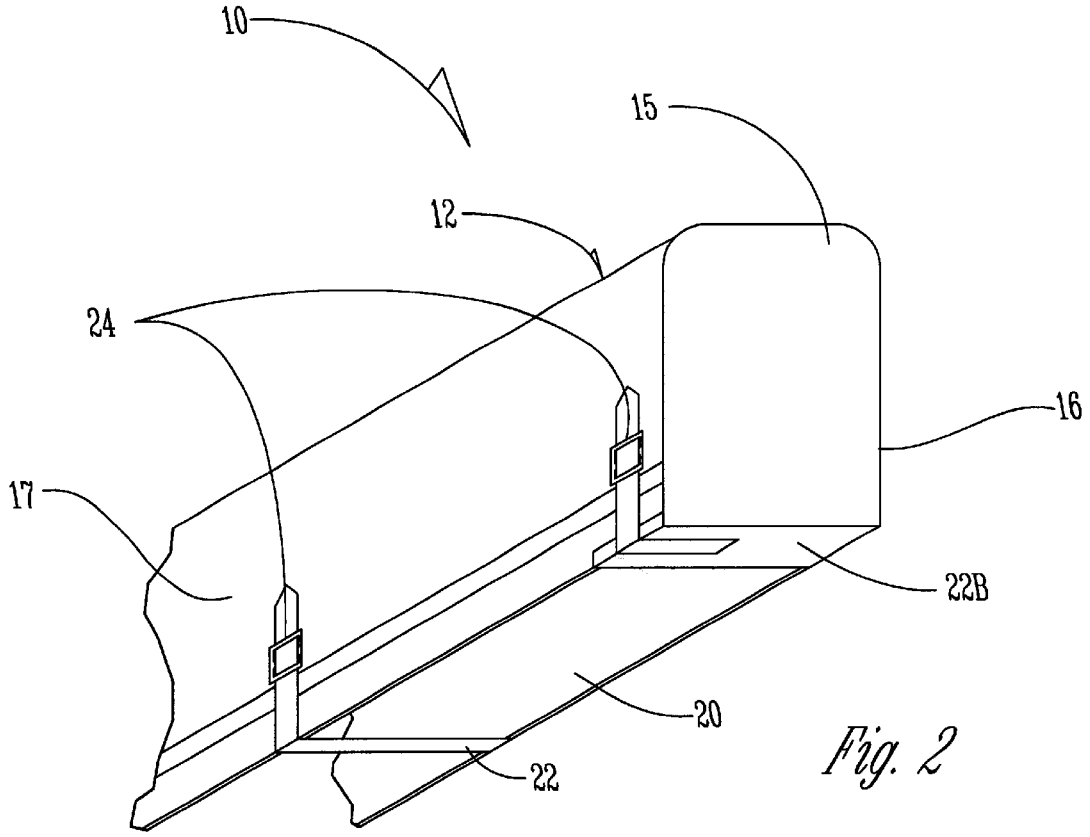
FIG. 2 is a perspective view of the extension end of the cover.
Figure 3:
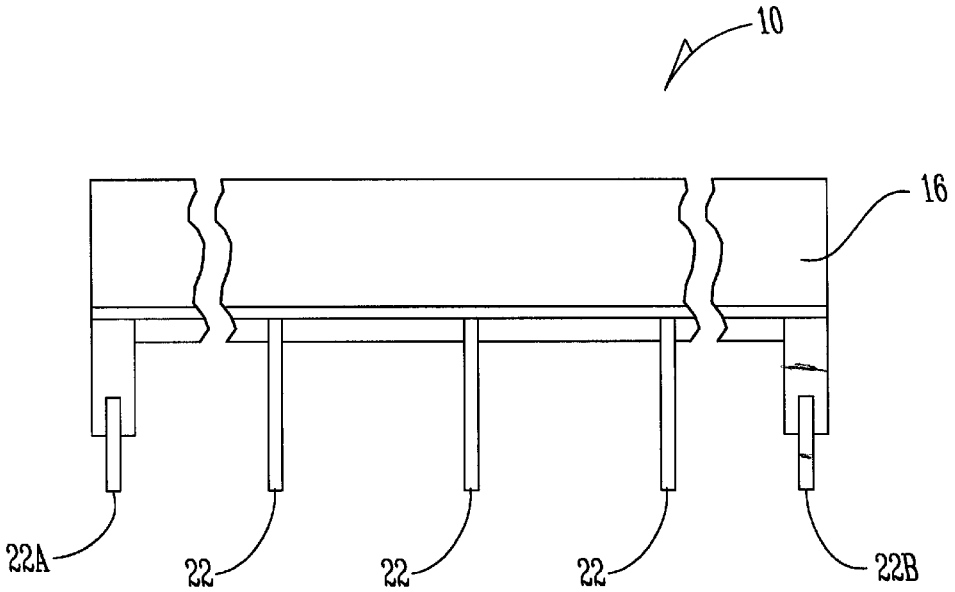
FIG. 3 is a side view of the cover.

In the preferred embodiment, the end straps 22A, 22B are positioned (FIG. 2) such that when extended across the open bottom 20 and detachably secured to the opposite side 17, the edge of the straps 22A, 22B align with the bottom edge of the opposite ends 14, 15 to form a temporary seal. Also, in the preferred embodiment, the end straps 22A, 22B have a width greater than other straps 22. These preferred positions and dimensions optimize the protection the cover 10 provides the ends 30 of the drill rods 32.

Figure 4:
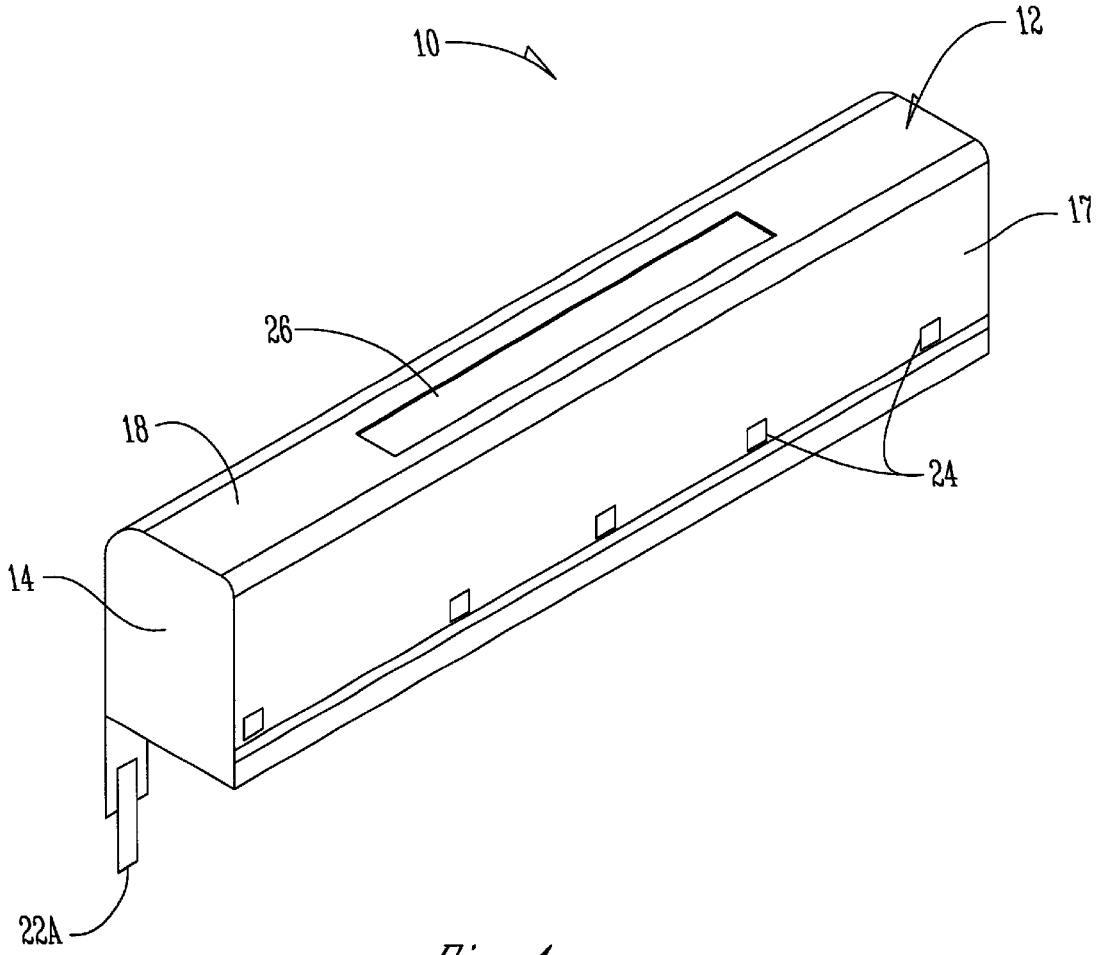
FIG. 4 is a perspective view of an alternative embodiment of the cover.

The cover 10 can be made of any flexible plastic, canvas, or rubber material. In one embodiment the top portion 18 of the canopy 12 has an open section 26 (FIG. 4). The shape of the cover 10 is generally rectangular, but can also have a triangular shape or other shapes as determined by the earth boring tool. It is therefore seen that the cover 10 will protect the ends of drill rods of an earth boring tool from moisture and dirt. This invention will therefore achieve all of the stated objectives.

What is claimed is:

1. A cover assembly for an earth boring tool comprising:

a canopy having opposite sides, opposite ends, a top portion, and an open bottom;

a plurality of straps secured to one side of said canopy extending across said open bottom and detachably secured to opposite side of said canopy; and said straps including two end straps that when extended across said open bottom and detachably secured to said opposite side will align with said ends of said canopy to form a seal said straps including additional straps between said end straps, said end straps being greater in width than said additional straps located therebetween.

2. The cover assembly of claim 1 wherein said canopy has a rectangular shape.

3. The cover assembly of claim 1 wherein said cover has an open section located within said top portion.

* * * * *